US005460736A

United States Patent [19]

Trinh et al.

[11] Patent Number: 5,460,736

[45] Date of Patent: Oct. 24, 1995

[54] FABRIC SOFTENING COMPOSITION CONTAINING CHLORINE SCAVENGERS

[75] Inventors: Toan Trinh, Maineville; Donald M. Swartley, Cincinnati, both of Ohio

[73] Assignee: The Procter & Gamble Company, Cincinnati, Ohio

[21] Appl. No.: 320,475

[22] Filed: Oct. 7, 1994

[51] Int. Cl.[6] ..... D06M 13/46

[52] U.S. Cl. ..... 252/8.8; 252/8.6

[58] Field of Search ..... 252/8.6, 8.8

[56] References Cited

U.S. PATENT DOCUMENTS

| | | | |
|---|---|---|---|
| 3,681,241 | 8/1972 | Rudy | 252/8.75 |
| 3,844,952 | 10/1974 | Booth | 252/8.75 |
| 3,893,954 | 7/1975 | Tivin et al. | 252/548 |
| 4,169,074 | 9/1979 | Conrad et al. | 252/544 |
| 4,365,061 | 12/1982 | Szejtli et al. | 536/103 |
| 4,560,492 | 12/1985 | Curry et al. | 252/110 |
| 4,661,267 | 4/1987 | Dekker et al. | 252/8.8 |
| 4,704,212 | 11/1987 | Schindler et al. | 252/8.8 |
| 4,711,730 | 12/1987 | Gosselink et al. | 252/8.75 |
| 4,715,979 | 12/1987 | Moore et al. | 252/91 |
| 4,749,596 | 6/1988 | Evans et al. | 427/242 |
| 4,767,547 | 8/1988 | Stratthof et al. | 252/8.8 |
| 4,810,413 | 3/1989 | Pancheri et al. | 252/174.12 |
| 4,818,569 | 4/1989 | Trinh et al. | 427/242 |
| 4,840,738 | 6/1989 | Hardy et al. | 252/8.6 |
| 4,844,823 | 7/1989 | Jacques et al. | 252/8.8 |
| 4,915,854 | 4/1990 | Mao et al. | 252/8.8 |
| 4,956,447 | 9/1990 | Gosselink et al. | 528/272 |
| 4,976,879 | 12/1990 | Maldonado et al. | 252/8.7 |
| 5,066,414 | 11/1991 | Chang | 252/8.8 |

FOREIGN PATENT DOCUMENTS

| | | |
|---|---|---|
| 086423A2 | 2/1982 | European Pat. Off. . |
| 122141A2 | 4/1983 | European Pat. Off. . |
| 032267A1 | 1/1990 | European Pat. Off. . |
| 409502A2 | 1/1991 | European Pat. Off. . |
| 479608A2 | 4/1992 | European Pat. Off. . |
| 507478A1 | 10/1992 | European Pat. Off. . |
| 3211532 | 9/1983 | Germany . |
| 240727A2 | 10/1987 | Germany . |
| 243735A2 | 11/1987 | Germany . |
| 1-229887 | 9/1989 | Japan . |
| 63-77470 | 10/1989 | Japan . |
| 91/12364A1 | 8/1991 | WIPO . |

*Primary Examiner*—Anthony Green
*Attorney, Agent, or Firm*—Beth Goldstein Lewis

[57] ABSTRACT

The present invention relates to a solid particulate or liquid rinse-added fabric softening composition containing specific chlorine scavengers. The solid particulate composition, comprises from about 50% to about 95%, by weight of the composition, of biodegradable, cationic quaternary ammonium fabric softening compound and an effective amount of chlorine scavenger selected from the group consisting of: amines; ammonium salts; amino acids, but not lysine; polyamino acids; polyethyleneimines; polyamines, but not di(higher alkyl)cyclic amines nor their condensation products; polyamineamides; polyacrylamides; and mixtures thereof. The solid particulate composition further comprises from about 0% to about 30%, by weight of the composition, of a modifier, for viscosity, dispersibility, or both; and from about 0% to about 20%, by weight of the composition, of a pH modifier. The liquid composition comprises from about 0.5% to about 50%, by weight of the composition, of biodegradable, cationic quaternary ammonium fabric softening compound, an effective amount of chlorine scavenger selected from the same group as for the solid particulate composition, from about 0% to about 30%, by weight of the composition of a modifier for viscosity, dispersibility, or both, and the balance comprising a liquid carrier selected from the group consisting of water, $C_1$–$C_4$ monohydric alcohols, $C_2$–$C_8$ polyhydric alcohols, liquid polyalkylene glycols, propylene carbonate, and mixtures thereof. The liquid compositions have a pH of from about 2 to about 5.

30 Claims, No Drawings

FABRIC SOFTENING COMPOSITION CONTAINING CHLORINE SCAVENGERS

TECHNICAL FIELD

The present invention relates to liquid and solid fabric softening compositions containing a low level of chlorine scavenger. The compositions minimize fading of fabric colors sensitive to the low levels of chlorine present in the rinse water.

BACKGROUND OF THE INVENTION

Chlorine is used in many parts of the world to sanitize water. To make sure that the water is safe, a small residual amount, typically about 1 to 2 parts per million (ppm), of chlorine is left in the water. At least about 10% of U.S. geography has about 2 ppm or more of chlorine in their tap water at some time. It has been found that this small amount of chlorine in the tap water can cause fading of some fabric dyes. The use of laundry detergent compositions containing chlorine scavengers to reduce the fading of fabric colors is known in the art. It is now discovered however, that much less chlorine scavenger, incorporated into rinse-added fabric softener compositions, provides a comparable benefit to detergent compositions containing higher amounts of chlorine scavengers. It is believed that in a typical wash, there is usually enough soil on the fabrics to scavenge residual chlorine and minimize damage to chlorine-sensitive dyes. However, in the rinse cycle the soil levels are greatly reduced and some dyes can fade after multiple laundering cycles. Thus, fading of fabric colors caused by tap water over time is more a result of the presence of residual chlorine in the rinse water than in the wash water. This is a problem which the presence of chlorine scavengers in the laundry detergent, which is depleted after the wash cycle, is unable to solve unless a large amount of chlorine scavenger which is retained on the fabrics is used to provide enough residual active for the rinse cycle. A secondary benefit of the rinse-added softener compositions of the present invention is their ability to eliminate or reduce the chlorine odor on laundered fabrics when a chlorine bleach is used in the wash for stain removal or sanitizing purposes. Another secondary benefit is the ability to use water-soluble chlorine scavengers that are not retained on the finished fabric. Retention can cause buildup and discoloration of the fabric and is therefore not desirable.

SUMMARY OF THE INVENTION

The present invention relates to a rinse-added fabric softening composition selected from the group consisting of:

I. a solid particulate composition, comprising:

(A) from about 50% to about 95%, by weight of the composition, of biodegradable, cationic quaternary ammonium fabric softening compound;

(B) an effective amount of chlorine scavenger selected from the group consisting of:

1. amines;
2. ammonium salts;
3. amino acids, but not lysine;
4. polyamino acids;
5. polyethyleneimines;
6. polyamines, but not all(higher alkyl)cyclic amines nor their condensation products;
7. polyamineamides;
8. polyacrylamides; and
9. mixtures thereof;

(C) from about 0% to about 30%, by weight of the composition, of a modifier, for viscosity, dispersibility, or both; and (D) from about 0% to about 20%, by weight of the composition, of a pH modifier; and II. a liquid composition, comprising:

(A) from about 0.5% to about 50%, by weight of the composition, of biodegradable, cationic quaternary ammonium fabric softening compound;

(B) an effective amount of chlorine scavenger selected from the group consisting of:

1. amines;
2. ammonium salts;
3. amino acids, but not lysine;
4. polyamino acids;
5. polyethyleneimines;
6. polyamines, but not all(higher alkyl)cyclic amines nor their condensation products;
7. polyamineamides;
8. polyacrylamides; and
9. mixtures thereof, (C) from about 0% to about 30%, by weight of the composition of a modifier for viscosity, dispersibility, or both;

(D) the balance comprising a liquid carrier selected from the group consisting of water, $C_1$–$C_4$ monohydric alcohols, $C_2$–$C_8$ polyhydric alcohols, liquid polyalkylene glycols, propylene carbonate, and mixtures thereof; and wherein said composition has a pH of from about 2 to about 5.

DETAILED DESCRIPTION OF THE INVENTION

The present invention relates to a rinse-added fabric softening composition selected from the group consisting of:

I. a solid particulate composition, comprising:

(A) from about 50% to about 95%, by weight of the composition, of biodegradable, cationic quaternary ammonium fabric softening compound;

(B) an effective amount of chlorine scavenger selected from the group consisting of:

1. amines;
2. ammonium salts;
3. amino acids, but not lysine;
4. polyamino acids;
5. polyethyleneimines;
6. polyamines, but not di(higher alkyl)cyclic amines nor their condensation products;
7. polyamineamides;
8. polyacrylamides; and
9. mixtures thereof;

(C) from about 0% to about 30%, by weight of the composition, of a modifier, for viscosity, dispersibility, or both; and (D) from about 0% to about 20%, by weight of the composition, of a pH modifier; and II. a liquid composition, comprising:

(A) from about 0.5% to about 50%, by weight of the composition, of biodegradable, cationic quaternary ammonium fabric softening compound;

(B) an effective amount of chlorine scavenger selected from the group consisting of:

1. amines;
2. ammonium salts;

3. amino acids, but not lysine;
4. polyamino acids;
5. polyethyleneimines;
6. polyamines, but not di(higher alkyl)cyclic amines nor their condensation products;
7. polyamineamides;
8. polyacrylamides; and
9. mixtures thereof, (C) from about 0% to about 30%, by weight of the composition of a modifier for viscosity, dispersibility, or both;

(D) the balance comprising a liquid carrier selected from the group consisting of water, $C_1$–$C_4$ monohydric alcohols, $C_2$–$C_8$ polyhydric alcohols, liquid polyalkylene glycols, propylene carbonate, and mixtures thereof; and wherein said composition has a pH of from about 2 to about 5.

(A) Biodegradable Cationic Fabric Softener Active

The preferred fabric softener active is biodegradable cationic ester quaternary ammonium softener active containing ester linkages in the long hydrophobic groups (EQA) having the formula:

$$E^{p+}[Y-R^2]_m pX^-$$

wherein p is 1 or 2;

m is 2 or 3;

each E is a nitrogenous quaternary ammonium group of charge $p^+$;

each Y is —O—(O)C—, or —C(O)—O—;

$R^2$ is the same or different $C_{11}$–$C_{22}$ hydrocarbyl or substituted hydrocarbyl substituent, preferably alkyl and/or alkenyl; and $X^-$ is any softener-compatible anion such as chloride, bromide, methylsulfate, ethyl sulfate, formate, nitrate and the like;

preferably E is selected from the group consisting of:

(1) $(R)_{4-m}N^+[(CH_2)_n]_m$ with m being 2 or 3;

(2)

$$(R)_3N^+(CH_2)_n\overset{|}{C}H-\overset{|}{C}H_2;$$

and (3) mixtures thereof, wherein n is 1 to 4;

each R is a $C_1$–$C_6$ alkyl or substituted alkyl group (e.g., hydroxy alkyl, hydroxy ethyl, hydroxy propyl), preferably $C_1$–$C_3$ alkyl group, e.g., methyl (most preferred), ethyl, propyl, and the like, a benzyl group, hydrogen, and mixtures thereof, and wherein $R^2$ is derived from $C_{11}$–$C_{22}$ fatty acyl groups.

A preferred EQA, with E of the formula (1) above, has the formula:

$$(R)_{4-m}N^+[(CH_2)_n-Y-R^2]_m X^-$$

wherein:

Y=—O—(O)C—, or —C(O)—O—; m=2 or 3; each n = 1 to 4; each R substituent is a short chain $C_1$–$C_6$, preferably $C_1$–$C_3$, alkyl group, e.g., methyl (most preferred), ethyl, propyl, and the like, $C_1$–$C_3$ hydroxyalkyl group, benzyl, or mixtures thereof, each $R^2$ is a long chain, preferably at least partially unsaturated, e.g., Iodine Value (IV) of greater than about 5 to less than about 100, $C_{11}$–$C_{22}$ hydrocarbyl, or substituted hydrocarbyl group; and the counterion, $X^-$, can be any softener-compatible anion, for example, chloride, bromide, methylsulfate, formate, sulfate, nitrate and the like.

Non-limiting examples of biodegradable softener actives with E (1) are N,N-di(tallowoyloxyethyl)-N,N-dimethylammonium chloride and N,N-di(tallowoxyethyl)-N-(2-hydroxyethyl)-N-methylammonium methyl sulfate.

A non-limiting example of a biodegradable softener active with E (2) is 1,2-ditallowoyloxy-3-trimethylammoniopropane chloride.

EQA compounds prepared with fully saturated alkyl groups ($R^2$) are rapidly biodegradable and excellent softeners. However, compounds prepared with at least partially unsaturated alkyl groups have many advantages (i.e., concentratability and good storage viscosity) and are highly acceptable for consumer products. EQA with unsaturated alkyl groups also provide improved fabric water absorbency as compared to EQA with saturated alkyl groups.

Variables that must be adjusted to obtain the largest benefits of using unsaturated acyl groups include the Iodine Value (IV) of the fatty acids; the cis/trans isomer weight ratios in the fatty acyl groups; and the odor of fatty acid and/or the EQA. Any reference to IV values hereinafter refers to IV of fatty acyl/alkyl groups and not to the resulting EQA compound.

When the IV of the fatty acyl groups is above about 20, the EQA provides excellent antistatic effect. Antistatic effects are especially important where the fabrics are dried in a tumble dryer, and/or where synthetic materials which generate static are used. Maximum static control occurs with an IV of greater than about 20, preferably greater than about 40. When fully saturated EQA compositions are used, poor static control results. Also, formulas with higher softener concentrations will typically require higher Iodine Values. The benefits of concentratability include: use of less packaging material; use of less organic solvents, especially volatile organic solvents; use of less concentration aids which may add nothing to performance; etc.

As the IV is raised, there is a potential for odor problems. Some highly desirable, readily available sources of fatty acids such as tallow, possess odors that remain with the compound EQA despite the chemical and mechanical processing steps which convert the raw tallow to finished EQA. Such sources must be deodorized, e.g., by absorption, distillation (including stripping such as steam stripping), etc., as is well known in the art. In addition, care must be taken to minimize contact of the resulting fatty acyl groups to oxygen and/or bacteria by adding antioxidants, antibacterial agents, etc. The additional expense and effort associated with the unsaturated fatty acyl groups is justified by the superior concentratability and/or performance. For example, EQA containing unsaturated fatty acyl groups can be concentrated above about 13% without the need for additional concentration aids, especially surfactant concentration aids.

EQA derived from highly unsaturated fatty acyl groups, i.e., fatty acyl groups having a total unsaturation above about 65% by weight, do not provide any additional improvement in antistatic effectiveness. They may, however, be able to provide other benefits such as improved water absorbency of the fabrics. In general, an IV range of from about 40 to about 65 is preferred for concentratability, maximization of fatty acyl sources, excellent softness, static control, etc.

Highly concentrated aqueous dispersions of diester compounds can gel and/or thicken during low (40° F.) temperature storage. Diester compounds made from only unsaturated fatty acids minimize this problem but additionally are more likely to cause malodor formation. Compositions containing diester compounds made from fatty acids having an IV of from about 5 to about 25, preferably from about 10 to about 25, more preferably from about 15 to about 20, and a cis/trans isomer weight ratio of from greater than about 30/70, preferably greater than about 50/50, more preferably greater than about 70/30, are storage stable at low temperature with minimal odor formation. These cis/trans isomer weight ratios provide optimal concentratability at these IV ranges. In the IV range above about 25, the ratio of cis to trans isomers is less important unless higher concentrations are needed. For any IV, the concentration that will be stable in an aqueous composition will depend on the criteria for stability (e.g., stable down to about 5° C.; stable down to 0° C.; doesn't gel; gels but recovers on heating; etc.) and the other ingredients present, but the concentration that is stable can be raised by adding concentration aids to achieve the desired stability.

Generally, hydrogenation of fatty acids to reduce polyunsaturation and to lower IV to insure good color and improved odor and odor stability leads to a high degree of trans configuration in the molecule. However, diester compounds derived from fatty acyl groups having low IV values can be made by mixing fully hydrogenated fatty acid with touch hydrogenated fatty acid at a ratio which provides an IV of from about 5 to about 25. The polyunsaturation content of the touch hardened fatty acid should be less than about 5%, preferably less than about 1%. During touch hardening the cis/trans isomer weight ratios are controlled by methods known in the art such as by optimal mixing, using specific catalysts, providing high $H_2$ availability, etc. Touch hardened fatty acid with high cis/trans isomer weight ratios is available commercially (i.e., Radiacid 406 from FINA).

It will be understood that $R^2$ can optionally be substituted with various groups such as alkoxyl or hydroxyl groups. Some of the preferred compounds can be considered to be diester variations of ditallow dimethyl ammonium chloride (DTDMAC), which is a widely used fabric softener. Preferably, at least about 80% of the EQA is the diester. Preferably, less than about 20%, more preferably less than about 10%, should be EQA monoester (e.g., only one —Y—$R^2$ group).

As used herein, when the diester is specified, it will include the monoester that is normally present. The level of monoester can be controlled during the manufacture of the EQA. Preferably, some of the monoester is present. The overall ratios of diester to monoester are from about 100:1 to about 2:1, preferably from about 50:1 to about 5:1, more preferably from about 13:1 to about 8:1. Under high detergent carry-over conditions, the di/monoester ratio is preferably about 11:1.

Liquid compositions of this invention typically contain from about 0.5% to about 50%, preferably from about 1% to about 35%, more preferably from about 4% to about 32%, of biodegradable diester quaternary ammonium softener active.

Particulate solid, granular compositions of this invention, as discussed hereinafter, typically contain from about 50% to about 95%, preferably from about 60% to about 90%, of biodegradable diester quaternary ammonium softener active.

(B) Chlorine Scavengers

Chlorine scavengers are actives that react with chlorine, or with chlorine-generating materials, such as hypochlorite, to eliminate or reduce the bleaching activity of the chlorine materials. For rinse-added fabric softener compositions, it is suitable to incorporate enough chlorine scavenger to neutralize about 10 ppm chlorine in rinse water, preferably to neutralize about 4 ppm chlorine, more preferably to neutralize about 2 ppm chlorine, and even more preferably to neutralize about 1 ppm in rinse water. For the elimination or reduction of fabric chlorine odor from the use of a chlorine bleach in the wash, the rinse-added fabric softener composition should contain enough chlorine scavenger to neutralize about 10 ppm in rinse water.

Typically, the softener composition of the present invention provides enough chlorine scavenger to react with about 0.1 ppm to about 40 ppm, preferably from about 0.2 ppm to about 20 ppm, and more preferably from about 0.3 ppm to about 10 ppm of chlorine present in an average rinse bath. Suitable levels of chlorine scavengers in the liquid softener composition of the present invention range from about 0.01% to about 10%, preferably from about 0.02% to about 5%, most preferably from about 0.03% to about 4%. If both the cation and the anion of the scavenger react with chlorine, which is desirable, the level is adjusted to react with an equivalent amount of available chlorine.

Non-limiting examples of chlorine scavengers include amines, preferably primary and secondary amines, including primary and secondary fatty amines, and alkanolamines; ammonium salts, e.g., chloride, bromide, citrate, sulfate; amine-functional polymers; amino acid homopolymers with amino groups and their salts, such as polyarginine, polylysine, polyhistidine; amino acid copolymers with amino groups and their salts, but not 1,5-di-ammonium-2-methylpanthene dichloride, nor lysine monohydrochloride; amino acids and their salts, preferably those having more than one amino group per molecule, such as arginine, histidine, not including lysine, reducing anions such as sulfite, bisulfite, thiosulfate, nitrite; antioxidants such as ascorbate, carbamate, phenols; and mixtures thereof.

Preferred chlorine scavengers are water soluble, especially, low molecular weight primary and secondary amines of low volatility, e.g., monoethanolamine, diethanolamine, tris(hydroxymethyl)aminomethane, hexamethylenetetramine. These amines are highly desirable even though they require the addition of more acid to counteract their inherent alkalinity.

Suitable chlorine scavenger polymers include: water soluble amine-functional polymers, e.g., polyethyleneimines, polyamines, polyamineamides, polyacrylamides, and mixtures thereof. The preferred polymers are polyethyleneimines, the polyamines, but not di(higher alkyl)cyclic amines nor their condensation products, and polyamiineamides. Preferred polymers for use in the fabric softening compositions of the present invention are polyethyleneimines. Preferred polyethyleneimines have a molecular weight of less than about 2000, more preferably from about 200 to about 1500.

Preferred chlorine scavengers for use in liquid rinse-added fabric softener compositions of this invention can be water soluble liquid or solid materials. Chlorine scavengers for use in solid rinse-added fabric softener compositions of this invention preferably are solid, e.g., water soluble amines, amine salts, and/or polymers. It is preferred that the chlorine scavenging amines-functional materials be neutralized by an acid, before they are added into the compositions. This neutralization actually converts the amines into ammonium salts. For liquid compositions, and solid compositions with liquid reconstitutability, chlorine scavengers containing inorganic polyvalent anions, e.g., sulfate, phosphate, can significantly increase the ionic strength of the liquid compositions, thus potentially causing adverse composition viscosity, e.g., gelling. In general, for liquid compositions, and solid compositions with liquid reconstitutability, preferred polymeric chlorine scavengers have an average molecular weight of less than about 5,000, more preferably from about 200 to about 2,000, even more preferably from about 200 to about 1,000. Low molecular weight polymers are easier to remove from fabrics, resulting in less buildup of the chlorine scavenger and therefore less discoloration of the fabrics.

Hydrogen peroxide and hydrogen peroxide-generating materials such as perborates, percarbonates, percarboxylic acids can perform as chlorine scavengers. However, they are outside the scope of the present invention, because they themselves can potentially cause fabric color fading.

Fabric softener compositions comprising the chlorine scavenger and the fabric softener active can be provided having various ratios and proportions of these two materials. Of course, the amount of chlorine scavenger can be varied, depending upon the level of residual chlorine expected in the rinse cycle.

(C) Optional Viscosity/Dispersibility Modifiers

Viscosity/dispersibility modifiers can be added for the purpose of concentrating the fabric softening compositions of the present invention.

(1) The Single-Long-Chain Alkyl Cationic Surfactant

The mono-long-chain-alkyl (water-soluble) cationic surfactants:

(a) in particulate granular compositions are at a level of from 0% to about 30%, preferably from about 3% to about 15%, more preferably from about 5% to about 15%, and (b) in liquid compositions are at a level of from 0% to about 30%, preferably from about 0.5% to about 10%, the total single-long-chain cationic surfactant present being at least at an effective level.

Such mono-long-chain-alkyl cationic surfactants useful in the present invention are, preferably, quaternary ammonium salts of the general formula:

$$[R^3N^{(+)}R_3]X^{(-)}$$

wherein the each R group is a $C_1$–$C_3$ alkyl or hydroxyalkyl group, e.g., methyl, ethyl, hydroxyethyl, and the like, hydrogen, and mixtures thereof, the $R^3$ group is $C_{10}$–$C_{22}$ hydrocarbon group, preferably $C_{12}$–$C_{18}$ alkyl group or the corresponding ester linkage interrupted group with a short alkylene ($C_1$–$C_4$) group between the ester linkage and the N, and having a similar hydrocarbon group, e.g., a fatty acid ester of choline, preferably $C_{12}$–$C_{14}$ (coco) choline ester and/or $C_{16}$–$C_{18}$ tallow choline ester. Each R and $X^{(-)}$ has the same meaning as before.

The ranges above represent the amount of the single-long-chain-alkyl cationic surfactant which is added to the composition of the present invention. The ranges do not include the amount of monoester which is already present in component (A), the diester quaternary ammonium compound, the total present being at least at an effective level.

The long chain group $R^3$, of the single-long-chain-alkyl cationic surfactant, typically contains an alkyl group having from about 10 to about 22 carbon atoms, preferably from about 12 to about 16 carbon atoms for solid compositions, and preferably from about 12 to about 18 carbon atoms for liquid compositions. This $R^3$ group can be attached to the cationic nitrogen atom through a group containing one, or more, ester, amide, ether, amine, etc., preferably ester, linking groups which can be desirable for increased hydrophilicity, biodegradability, etc. Such linking groups are preferably within about three carbon atoms of the nitrogen atom. Suitable biodegradable single-long-chain alkyl cationic surfactants containing an ester linkage in the long chain are described in U.S. Pat. No. 4,840,738, Hardy and Walley, issued Jun. 20, 1989, said patent being incorporated herein by reference.

If the corresponding, non-quaternary amines are used, any acid (preferably a mineral or polycarboxylic acid) which is added to keep the ester groups stable will also keep the amine protonareal in the compositions and preferably during the rinse so that the amine has a cationic group. The composition is adjusted to a pH of from about 2 to about 5, preferably from about 2 to about 4, to maintain an appropriate, effective charge density in the aqueous liquid concentrate product and upon further dilution e.g., to form a less concentrated product and/or upon addition to the rinse cycle of a laundry process.

It will be understood that the main function of the water-soluble cationic surfactant is to lower the viscosity of the composition and/or increase the dispersibility of the diester softener compound and it is not, therefore, essential that the cationic surfactant itself have substantial softening properties, although this may be the case. Also, surfactants having only a single long alkyl chain, presumably because they have greater solubility in water, can protect the diester softener from interacting with anionic surfactants and/or detergent builders that are carried over into the rinse.

Other cationic materials with ring structures such as alkyl imidazoline, imidazolinium, pyridine, and pyridinium salts having a single $C_{12}$–$C_{30}$ alkyl chain can also be used. Very low pH is required to stabilize, e.g., imidazoline ring structures. Some alkyl imidazolinium salts useful in the present invention have the general formula:

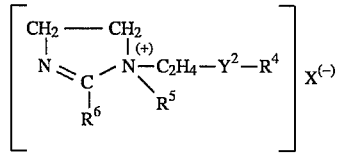

wherein $Y^2$ is —C(O)—O—, —O—(O)—C—, —C(O)—N($R^7$), or —N($R^7$)—C(O)— in which $R^7$ is hydrogen or a $C_1$–$C_4$ alkyl group; $R^5$ is a $C_1$–$C_4$ alkyl group; $R^4$ and $R^6$ are each independently selected from R and $R^3$ as defined hereinbefore for the single-long-chain cationic surfactant, with only one being $R^3$, and $X^{(-)}$ has the same meaning as before.

Some alkyl pyridinium salts useful in the present invention have the general formula:

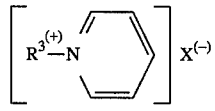

wherein $R^3$ and $X^{(-)}$ are as defined above. A typical material of this type is cetyl pyridinium chloride.

Amine oxides can also be used. Suitable amine oxides include those with one alkyl or hydroxyalkyl moiety of about 8 to about 22 carbon atoms, preferably from about 10 to about 18 carbon atoms, more preferably from about 8 to about 14 carbon atoms, and two alkyl moieties selected from the group consisting of alkyl groups and hydroxyalkyl groups with about 1 to about 3 carbon atoms.

Examples include dimethyloctylamine oxide, diethyldecylamine oxide, bis(2-hydroxyethyl)dodecylamine oxide, dimethyldodecylamine oxide, dipropyltetradecylamine oxide, methylethylhexadecylamine oxide, dimethyl-2-hydroxyoctadecylamine oxide, and coconut fatty alkyl dimethylamine oxide.

(2) Nonionic Surfactant (Alkoxylated Materials)

Suitable nonionic surfactants to serve as the viscosity/dispersibility modifier include addition products of ethylene oxide and, optionally, propylene oxide, with fatty alcohols, fatty acids, fatty amines, etc. They are referred to as ethoxylated fatty alcohols, ethoxylated fatty acids, and ethoxylated fatty amines.

Any of the alkoxylated materials of the particular type described hereinafter can be used as the nonionic surfactant. In general terms, the nonionic herein, when used alone, in solid compositions are at a level of from about 5% to about 20%, preferably from about 8% to about 15%, and in liquid compositions are at a level of from 0% to about 5%, preferably from about 0.1% to about 5%, more preferably from about 0.2% to about 3%. Suitable compounds are substantially water-soluble surfactants of the general formula:

$$R^2—Y^3—(C_2H_4O)_n—C_2H_4OH$$

wherein $R^2$ for both solid and liquid compositions is selected from the group consisting of primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of from about 8 to about 20, preferably from about 10 to about 18 carbon atoms. More preferably the hydrocarbyl chain length for liquid compositions is from about 16 to about 18 carbon atoms and for solid compositions from about 10 to about 14 carbon atoms. In the general formula for the ethoxylated nonionic surfactants herein, $Y^3$ is typically —O—, —C(O)O—, —C(O)N(R)—, or —C(O)N(R)R—, in which $R^2$, and R, when present, have the meanings given hereinbefore, and/or R can be hydrogen, and n is at least about 8, preferably at least about 10-11. Performance and, usually, stability of the softener composition decrease when fewer ethoxylate groups are present.

The nonionic surfactants herein are characterized by an HLB (hydrophilic-lipophilic balance) of from about 7 to about 20, preferably from about 8 to about 15. Of course, by defining $R^2$ and the number of ethoxylate groups, the HLB of the surfactant is, in general, determined. However, it is to be noted that the nonionic ethoxylated surfactants useful herein, for concentrated liquid compositions, contain relatively long chain $R^2$ groups and are relatively highly ethoxylated. While shorter alkyl chain surfactants having short ethoxylated groups may possess the requisite HLB, they are not as effective herein.

Nonionic surfactants as the viscosity/dispersibility modifiers are preferred over the other modifiers disclosed herein for compositions with higher levels of perfume.

Examples of nonionic surfactants follow. The nonionic surfactants of this invention are not limited to these examples. In the examples, the integer defines the number of ethoxy (EO) groups in the molecule.

(3) Straight-Chain, Primary Alcohol Alkoxylates

The deca-, undeca-, dodeca-, tetradeca-, and pentadeca-ethoxylates of n-hexadecanol, and n-octadecanol having an HLB within the range recited herein are useful viscosity/dispersibility modifiers in the context of this invention. Exemplary ethoxylated primary alcohols useful herein as the viscosity/dispersibility modifiers of the compositions are n-$C_{18}$EO(10); and n-$C_{10}$EO(11). The ethoxylates of mixed natural or synthetic alcohols in the "tallow" chain length range are also useful herein. Specific examples of such materials include tallowalcohol-EO(11), tallowalcohol-EO(18), and tallowalcohol-EO(25).

(4) Straight-Chain, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having an HLB within the range recited herein are useful viscosity/dispersibility modifiers in the context of this invention. Exemplary ethoxylated secondary alcohols useful herein as the viscosity/dispersibility modifiers of the compositions are: 2-$C_{16}$EO(11); 2-$C_{20}$EO(11); and 2-$C_{16}$EO(14).

(5) Alkyl Phenol Alkoxylates

As in the case of the alcohol alkoxylates, the hexa- through octadeca-ethoxylates of alkylated phenols, particularly monohydric alkylphenols, having an HLB within the range recited herein are useful as the viscosity/dispersibility modifiers of the instant compositions. The hexa- through octadeca-ethoxylates of p-tridecylphenol, m-pentadecylphenol, and the like, are useful herein. Exemplary ethoxylated alkylphenols useful as the viscosity/dispersibility modifiers of the mixtures herein are: p-tridecylphenol EO(11) and p-pentadecylphenol EO(18).

As used herein and as generally recognized in the art, a phenylene group in the nonionic formula is the equivalent of an alkylene group containing from 2 to 4 carbon atoms. For present purposes, nonionic containing a phenylene group are considered to contain an equivalent number of carbon atoms calculated as the sum of the carbon atoms in the alkyl group plus about 3.3 carbon atoms for each phenylene group.

(6) Olefinic Alkoxylates

The alkenyl alcohols, both primary and secondary, and alkenyl phenols corresponding to those disclosed immediately hereinabove can be ethoxylated to an HLB within the range recited herein and used as the viscosity/dispersibility modifiers of the instant compositions.

(7) Branched Chain Alkoxylates

Branched chain primary and secondary alcohols which are available from the well-known "OXO" process can be ethoxylated and employed as the viscosity/dispersibility modifiers of compositions herein.

The above ethoxylated nonionic surfactants are useful in the present compositions alone or in combination, and the term "nonionic surfactant" encompasses mixed nonionic surface active agents.

(8) Mixtures

The term "mixture" includes the nonionic surfactant and the single-long-chain-alkyl cationic surfactant added to the composition in addition to any monoester present in the DEQA.

Mixtures of the above viscosity/dispersibility modifiers are highly desirable. The single long chain cationic surfactant provides improved dispersibility and protection for the primary DEQA against anionic surfactants and/or detergent builders that are carried over from the wash solution.

Mixtures of the viscosity/dispersibility modifiers are present for solid compositions at a level of from about 3% to about 30%, preferably from about 5% to about 20%, and for liquid compositions at a level of from about 0.1% to about 30%, preferably from about 0.2% to about 20%, by weight of the composition.

(D) Optional pH Modifier

Since the biodegradable cationic diester quaternary ammonium fabric softener actives are somewhat labile to hydrolysis, it is preferable to include optional pH modifiers in the solid particulate composition, to which water is to be added, to form stable dilute or concentrated liquid softener compositions. Said reconstituted stable liquid compositions should have a pH (neat) of from about 2 to about 5, preferably from about 2 to about 4.5, more preferably from about 2 to about 4.

The pH can be adjusted by incorporating a solid, water-soluble Bronsted acid. Examples of suitable Bronsted acids include inorganic mineral acids, such as boric acid, sodium bisulfate, potassium bisulfate, sodium phosphate monobasic, potassium phosphate monobasic, and mixtures thereof; organic acids, such as citric acid, gluconic acid, glutamic acid, tartaric acid, fumaric acid, maleic acid, malic acid, tannic acid, glycolic acid, chloroacetic acid, phenoxyacetic acid, 1,2,3,4-butane tetracarboxylic acid, benzene sulfonic acid, ortho-toluene sulfonic acid, para-toluene sulfonic acid, phenol sulfonic acid, naphthalene sulfonic acid, benzene phosphonic acid, oxalic acid, 1,2,4,5-pyromellitic acid, 1,2,4-trimellitic acid, adipic acid, benzoic acid, phenylacetic acid, salicylic acid, succinic acid, and mixtures thereof; and mixtures of mineral inorganic acids and organic acids. Preferred pH modifiers are citric acid, gluconic acid, tartaric acid, malic acid, 1,2,3,4-butane tetracarboxylic acid, and mixtures thereof.

Optionally, materials that can form solid clathrates such as cyclodextrins and zeolites can be used as adjuvants in the solid particulate composition as host carriers of concentrated liquid acids, such as acetic acid, HCl, sulfuric acid, phosphoric acid, nitric acid, etc. Examples of inclusion complexes of phosphoric acid, sulfuric acid, and nitric acid, and process for their preparation are disclosed in U.S. Pat. No. 4,365,061, issued Dec. 21, 1982 to Szejtli et al., said patent being incorporated herein by reference.

When used, the pH modifier is typically used at a level of from about 0.01% to about 20%, preferably from about 0.1% to about 10%, more preferably from about 0.2% to about 5%.

(E) Liquid Carrier

The liquid carrier used in the instant compositions is preferably an aqueous system comprising water and, optionally, a low molecular weight organic solvent that is highly soluble in water, e.g., $C_1$–$C_4$ monohydric and $C_2$–$C_6$ polyhydric alcohols, alkylene glycols, polyalkylene glycols, alkylene carbonates, and mixtures thereof. Examples of these water soluble solvents include ethanol, propanol, isopropanol, n-butyl alcohol, t-butyl alcohol, ethylene glycol, diethylene glycol, propylene glycol, glycerol, propylene carbonate, and mixtures thereof. Water is a preferred liquid carrier due to its low cost, availability, safety, and environmental compatibility. Water can be distilled, deionized, or tap water. Mixtures of water and a low molecular weight short chain alcohol such as ethanol, propanol, isopropanol, and mixtures thereof, are also preferred carriers.

The level of liquid carrier in the instant liquid compositions is greater than about 50%, preferably greater than about 65%, more preferably greater than 70%. The level of water in the liquid carrier is more than about 50%, preferably more than about 80%, more preferably more than about 85%, by weight of the carrier.

In another aspect of the invention, water can be added to the particulate, granular solid compositions to form dilute or concentrated liquid softener compositions with a concentration of said diester softening compound of from about 0.5% to about 50%, preferably from about 1% to about 35%, more preferably from about 4% to about 32%. The benefits of adding water to the particulate solid composition to form aqueous compositions to be added later to the rinse bath include the ability to transport less weight making shipping more economical, and the ability to form liquid compositions similar to those that are normally sold to consumers with low energy input, i.e., less shear and/or lower temperature. Furthermore, the particulate, granular solid fabric softener compositions, when sold directly to the consumers, have less packaging requirements and smaller and more disposable containers. The consumers will then pre-dilute the solid compositions into available permanent containers, ready for laundry treatment, with the liquid product form easier to handle, viz., simplifying measuring and dispensing.

(F) Other Optional Ingredients

1. Stabilizers

Stabilizers can be present in the compositions of the present invention. The term "stabilizer", as used herein, includes antioxidants and reductive agents. These agents are present at a level of from about 0% to about 2%, by weight of the composition, preferably form about 0.01% to about 0.2%, more preferably from about 0.035% to about 0.1%, by weight of the composition, for antioxidants, and more preferably from about 0.01% to about 0.2%, by weight of the composition, for reductive agents. These assure good odor stability under long term storage conditions for the compositions and compounds stored in molten form. The use of antioxidants and reductive agent stabilizers is especially critical for unscented or low scent products (no or low perfume).

Examples of antioxidants that can be added to the compositions of this invention include a mixture of ascorbic acid, ascorbic palmitate, propyl gallate, available from Eastman Chemical Products, Inc. (Eastman) under the trade names Tenox® PG and Tenox® S-1; a mixture of BHT (butylated hydroxytoluene), BHA (butylated hydroxyanisole), propyl gallate, and citric acid, available from Eastman, under the trade name Tenox-6®; butylated hydroxytoluene, available from UOP Process Division under the trade name Sustane® BHT; tertiary butylhydroquinone, available from Eastman under the trade name Tenox® TBHQ; natural tocopherols, available from Eastman under the trade name Tenox® GT-1/GT-2; and butylated hydroxyanisole, available form Eastman under the trade name BHA®; long chain esters ($C_8$–$C_{22}$) of gallic acid, e.g., dodecyl gallate; Irganox® 1010; Irganox® 1035; Irganox® B 1171; Irganox® 1425 Irganox® 3114; Irganox®3125; and mixtures thereof, preferably Irganox® 3125, Irganox® 1425, Irganox® 3114, and mixtures thereof, more preferably Irganox® 3 125 alone or mixed with citric acid. The chemical names and C AS numbers for some of the above stabilizers are listed in Table I below.

TABLE I

| Antioxidant | CAS No. | Chemical Name used in Code of Federal Regulations |
|---|---|---|
| Irganox ® 1010 | 6682-19-8 | Tetrakis[methylene(3,5-di-tert-butyl-4-hydroxyhydrocinnamate)]methane |

TABLE I-continued

| Antioxidant | CAS No. | Chemical Name used in Code of Federal Regulations |
|---|---|---|
| Irganox ® 1035 | 41484-35-9 | Thiodiethylene bis(3,5-di-tert-butyl-4-hydroxyhydrocinnamate |
| Irganox ® 1098 | 23128-74-7 | N,N'-Hexamethylene bis(3,5-di-tert-butyl-4-hydroxyhydro-cinnamamide |
| Irganox ® B1171 | 31570-04-4 23128-74-7 | 1:1 Blend Irganox ® 1098 and Irgafos ® 168 |
| Irganox ® 1425 | 65140-91-2 | Calcium bis[monoethyl(3,5-di-tert-butyl-4-hydroxybenzyl) phosphonate] |
| Irganox ® 3114 | 27676-62-6 | 1,3,5-Tris(3,5-di-tert-butyl-4-hydroxybenzyl)-s-triazine-2,4,6-(1H, 3H, 5H)trione |
| Irganoxl ® 3125 | 34137-09-2 | 3,5-Di-tert-butyl-4-hydroxy-hydrocinnamic acid triester with 1,3,5-tris(2-hydroxyethyl)-S-triazine-2,4,6-(1H,3H,5H)-trione |
| Irgafos ® 168 | 31570-04-4 | Tris(2,4-di-tert-butyl-phenyl)phosphite |

Examples of reductive agents include sodium borohydride, hypophosphorous acid, Irgafos® 168, and mixtures thereof.

2. Inorganic Viscosity Control Agents

Inorganic viscosity control agents such as water-soluble, ionizable salts can also optionally be incorporated into the compositions of the present invention. A wide variety of ionizable salts can be used. Examples of suitable salts are the halides of the Group IA and IIA metals of the Periodic Table of Elements, e.g., calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 10,000 ppm, preferably from about 20 to about 4,000 ppm, by weight of the composition.

3. Silicone Component

The fabric softening compositions herein optionally contain an aqueous emulsion of a predominantly linear polydialkyl or alkyl aryl siloxane in which the alkyl groups can have from one to five carbon atoms and can be wholly, or partially, fluoridated. These siloxanes act to provide improved fabric benefits. Suitable silicones are polydimethyl siloxanes having a viscosity, at 25° C., of from about 100 to about 100,000 centistokes, preferably from about 1,000 to about 12,000 centistokes. In some applications as low as 1 centistoke materials are preferred.

The fabric softening compositions herein can contain from about 0.1% to about 10%, of the silicone component.

4. Thickening Agent

Optionally, the fabric softening compositions herein contain from 0% to about 3%, preferably from about 0.01% to about 2%, of a thickening agent. Examples of suitable thickening agents include: cellulose derivatives, synthetic high molecular weight polymers (e.g., carboxyvinyl polymer and polyvinyl alcohol), and cationic guar gums.

The cellulosic derivatives that are functional as thickening agents herein can be characterized as certain hydroxyethers of cellulose, such as Methotel®, marketed by Dow Chemicals, Inc.; also, certain cationic cellulose ether derivatives, such as Polymer JR-125®, JR-400®, and JR-30M®, marketed by Union Carbide.

Other effective thickening agents are cationic guar gums, such as Jaguar Plus®, marketed by Stein Hall, and Gendrive® 458, marketed by General Mills. Preferred thickening agents herein are selected from the group consisting of methyl cellulose, hydroxypropyl methylcellulose, hydroxybutyl methylcellulose, or mixtures thereof, said cellulosic polymer having a viscosity in 2% aqueous solution at 20° C. of from about 15 to about 75,000 centipoises.

5. Soil Release Agent

In the present invention, an optional soil release agent can be added. The softening composition prepared by the process of the present invention herein can contain from 0% to about 10%, preferably from 0.2% to about 5%, of a soil release agent. Preferably, such a soil release agent is a polymer. Polymeric soil release agents useful in the present invention include copolymeric blocks of terephthalate and polyethylene oxide or polypropylene oxide, and the like.

A more complete disclosure of soil release agents is contained in U.S. Pat. No. 4,661,267, Decker et al., issued Apr. 28, 1987; U.S. Pat. No. 4,711,730, Gosselink et al., issued Dec. 8, 1987; U.S. Pat. No. 4,749,596, Evans et al., issued Jun. 7, 1988; U.S. Pat. No. 4,818,569, Trinh et al., issued Apr. 4, 1989; U.S. Pat. No. 4,877,896, Maldonado et al., issued Oct. 31, 1989; U.S. Pat. No. 4,956,447, Gosselink et al., issued Sep. 11, 1990; and 4,976,879, Maldonado et al., issued Dec. 11, 1990, all of said patents incorporated herein by reference.

6. Scum Dispersant

In the present invention, an optional scum dispersant, other than the soil release agent, can be added.

The preferred scum dispersants herein are formed by highly ethoxylating hydrophobic materials. The hydrophobic material can be a fatty alcohol, fatty acid, fatty amine, fatty acid amide, amine oxide, quaternary ammonium compound, or the hydrophobic moieties used to form soil release polymers. The preferred scum dispersants are highly ethoxylated, e.g., more than about 17, preferably more than about 25, more preferably more than about 40, moles of ethylene oxide per molecule on the average, with the polyethylene oxide portion being from about 76% to about 97%, preferably from about 81% to about 94%, of the total molecular weight.

The level of scum dispersant is sufficient to keep the scum at an acceptable, preferably unnoticeable to the consumer, level under the conditions of use, but not enough to adversely affect softening. For some purposes it is desirable that the scum is nonexistent. Depending on the amount of anionic or nonionic detergent, etc., used in the wash cycle of a typical laundering process, the efficiency of the rinsing steps prior to the introduction of the compositions herein, and the water hardness, the amount of anionic or nonionic detergent surfactant and detergency builder (especially phosphates) entrapped in the fabric (laundry) will vary. Normally, the minimum amount of scum dispersant should be used to avoid adversely affecting softening properties. Typically scum dispersion requires at least about 2%, preferably at least about 4% (at least 6% and preferably at least 10% for maximum scum avoidance) based upon the level of softener active. However, at levels of about 10% (relative to the softener material) or more, one risks loss of softening efficacy of the product especially when the fabrics contain high proportions of nonionic surfactant which has been absorbed during the washing operation.

Preferred scum dispersants are: Brij® 700; Varonic® U-250; Genapol® T-500, Genapol® T-800; Plurafac® A-79; and Neodol® 25-50.

7. Bacteriocides

Examples of bacteriocides used in the compositions of this invention include glutaraldehyde, formaldehyde, 2-bromo-2-nitro-propane-1,3-diol sold by Inolex Chemicals, located in Philadelphia, Pennsylvania, under trade name Bronopol®, and a mixture of 5-chloro-2-methyl-4-isothiazoline-3-one and 2-methyl-4-isothiazoline-3-one sold by Rohm and Haas Company under the trade name Kathon® CG/ICP. Typical levels of bacteriocides used in the present compositions are from about 1 to about 1,000 ppm by weight of the composition.

8. Other Optional Ingredients

The present invention can include optional components conventionally used in textile treatment compositions, for example, short chain alcohols such as ethanol, or propylene glycol, colorants, perfumes, preservatives, optical brighteners, opacifiers, surfactants, stabilizers such as guar gum and polyethylene glycol, anti-shrinkage agents, fabric crisping agents, spotting agents, germicides, fungicides, anti-corrosion agents, and the like.

(G) Method of Treatment

The compositions of the present invention are preferably used in the rinse cycle of the conventional automatic laundry operations. Generally, rinse water has a temperature of from about 5° C. to about 60° C.

Fabrics or fibers are contacted with an effective amount, generally from about 10 ml to about 300 ml (per 3.5 kg of fiber or fabric being treated), of the compositions herein in an aqueous bath. Of course, the amount used is based upon the judgment of the user, depending on concentration of the softening material, fiber or fabric type, degree of softness desired, and the like. Typically, from about 10 ml to about 300 ml of from about 5% to about 40% dispersion of the biodegradable cationic fabric softener active and from about 0.001% to about 10% of chlorine scavenger is used in an about 20 gallon laundry rinse bath to soften, provide anti-static benefits, and to prevent or reduce fading to a 3.5 kg load of mixed fabrics. Preferably, the rinse bath contains from about 20 ppm to about 250 ppm of the fabric softening material and from about 0.02 ppm to about 20 ppm of the chlorine scavenger herein. More preferably for United States conditions, the rinse bath contains from about 50 ppm to about 150 ppm of the fabric softening material and from about 0.3 ppm to about 10 ppm of the chlorine scavenger. More preferably for European conditions, the rinse bath contains from about 250 ppm to about 450 ppm of the fabric softening material and from about 0.2 ppm to about 20 ppm of the chlorine scavenger. More preferably for Japanese conditions, the rinse bath contains from about 30 ppm to about 80 ppm of the fabric softening materials and from about 0.2 ppm to about 10 ppm of the chlorine scavenger. These concentration levels achieve superior fabric softening, static control, and color protection.

The invention is exemplified by the following non-limiting examples in which all numerical values are approximations consistent with normal experience.

EXAMPLES I TO III

| EXAMPLES I TO III | | | |
|---|---|---|---|
| Components | I Wt. % | II Wt. % | III Wt. % |
| Ester Quat Compound (1) | 9.46 | — | — |
| Ester Quat Compound (2) | — | 10.1 | 30.6 |
| Isopropyl Alcohol | 0.38 | — | — |

-continued

| EXAMPLES I TO III | | | |
|---|---|---|---|
| Components | I Wt. % | II Wt. % | III Wt. % |
| Monoethanolamine (30.9%) | 0.71 | — | — |
| 2-Amino-2-methyl-1, 3-propanediol | — | 0.43 | — |
| Ammonium Chloride (25%) | — | — | 3.0 |
| HCl (25%) | 0.34 | 0.34 | — |
| HCl (1%) | — | — | 2.25 |
| DC-2210 Antifoam | — | — | 0.25 |
| $CaCl_2$ (25%) | — | — | 2.0 |
| Blue Dye (1%) | — | — | 0.13 |
| Tenox ® 6 | — | — | 0.035 |
| Kathon ® (1.5%) | — | — | 0.02 |
| Perfume | — | — | 1.35 |
| Deionized Water | Balance | Balance | Balance |

(1)Di(hardened tallowoyloxyethyl) dimethyl ammonium chloride.

(2) Di(soft tallowoyloxyethyl) dimethyl ammonium chloride where the fatty acyl groups are derived from fatty acids with IV of about 55, % unsaturation of about 53.1, and $C_{18}$ cis/trans isomer ratio of about 8.2 (% cis isomer about 40.0 and % trans isomer about 4.9); the diester includes monoester at a weight ratio of about 11:1 diester to monoester; 86% solids in ethanol.

EXAMPLE I—PROCESS

About 14 g of a monoethanolamine solution (about 30.9%) already acidified with HCl to pH 2.1 and about 0.7 g of a HCl solution (25%) are added to about 1790 g deionized water pre-heated to about 74° C. in a 3-L stainless steel mix tank. The water seat is mixed with an IKA mixer (Model RW 20 DZM) at about 2000 rpm using an impeller with about 5.1 cm diameter blades. A mixture of about 189 g of a di(hardened tallowoyloxyethyl) dimethyl ammonium chloride and about 8 g of isopropyl alcohol, pre-heated to about 89° C., is then slowly added to the water seat via a gravity-fed drop funnel so that the premix is injected near the mixer impeller. The mix temperature immediately following the softener addition is about 73° C. and the pH is about 3.5. An additional amount of about 6.14 g of HCl is added to reduce the pH of the mix to about 2.0. The batch is cooled to about 23° C. by cooling the mix in an ice water bath while the mix is still being stirred.

EXAMPLE II—PROCESS

The making procedure of Example 2 is similar to that of Example 1, except that soft tallow softener is used instead of the hardened tallow softener, and 2-amino-2-methyl-1,3-propanediol is used instead of monoethanolamine.

EXAMPLE III—PROCESS

The composition of example III is made by the following process:

1. Separately, heat the diester compound premix with the Tenox 6 antioxidant, and the water seat containing HCl and antifoam agent to about 75° C.
2. Add the diester compound premix into the water seat. During the injection, both mix and mill the batch.
3. Add about 10% of the $CaCl_2$ at approximately halfway through the injection.
4. Add about 40% of the $CaCl_2$ with mixing, after premix injection is complete.
5. Add perfume, then dye and Kathon, with mixing.
6. Cool batch to about 20°–27° C.
7. Add with mixing the remainder of the $CaCl_2$, the ammonium chloride, and the dye solutions to the cooled batch.

EXAMPLES IV AND V

| Examples IV and V | | |
|---|---|---|
| Components | IV Wt. % | V Wt. % |
| Hydroxyethyl Ester Quat (1) | 9.80 | — |
| Propyl Ester Quat (2) | — | 8.67 |
| Ethanol | — | 1.20 |
| Polyethyleneimine MW 600 | 0.15 | — |
| Monoethanolamine (30.9%) | — | 0.71 |
| HCl (25%) | 0.45 | 0.36 |
| Perfume | 0.45 | 0.30 |
| Dye Solution (1%) | 0.08 | — |
| Kathon CG (1.50%) | 0.02 | 0.02 |
| $CaCl_2$ (25%) | 0.06 | 0.06 |
| Deionized Water | Balance | Balance |

(1) Di (tallowoyloxyethyl) (2-hydroxyethyl) methyl ammonium methyl sulfate, 85% active in ethanol.
(2) 1,2-di (hardenedtallowoyloxy)-3-trimethylammonium propane chloride.

EXAMPLE IV PROCESS

About 4.5 g of HCl solution (25%) and about 1.5 g of polyethyleneimine M.W. 600 are added to about 889 g deionized water and pre-heated to about 70° C. in a 1.5 L stainless steel mix tank. This "waterseat" is mixed with an IKA mixer (Model RW 25) at about 1000 rpm using an impeller with about 5.1 cm diameter blades. About 98 g of Stepanquat 6585-ET containing about 85% hydroxyethyl ester quat in ethanol is pre-heated to about 70° C., and is then slowly added to the water seat by injection at the impeller blades via a peristaltic pump. The mixture is cooled during mixing, and about 4.5 g of perfume, about 0.2 g of 1.5% Kathon CG solution, and about 0.8% of a dye solution are added when the mixture temperature reaches about 45° C. About 0.6 g of a 25% of a $CaCl_2$ solution is added when the mixture temperature reaches about 27° C. The mixing is stopped when the batch temperature reaches about 24° C.

EXAMPLE V PROCESS

About 3.6 g of HCl solution (25%) and about 7.1 g of a monoethanolamine solution (about 30.9%) which is already acidified separately with HCl to pH 2.1 are added to about 887 g deionized water and pre-heated to about 74° C. in a 1.5 L stainless steel mix tank. The water seat is mixed with an IKA mixer (Model RW 20 DZM) at about 1000 rpm using an impeller with about 5.1 cm diameter blades. The mixture is also milled at the same time. A mixture of about 86.7 g of the propyl ester quat and about 12 g of ethanol is pre-heated to about 82° C. and is then slowly added to the water seat, injected at the impeller blades via a gravity-fed drop funnel. The mixer rpm is increased to about 1500 rpm during this addition. About 0.3 g of $CaCl_2$ solution (25%) is added to reduce the viscosity of the mixture and the mixture rpm is reduced to about 1000 rpm. About 0.2 g of a 1.5% Kathon CG solution is added. The mixture is chilled in an ice water bath while still mixing. The mill is turned off at this point. Another 0.3 g of 25% $CaCl_2$ solution is added when the mixture temperature reaches about 27° C. Then about 3 g of perfume is added with mixing.

The particulate, granular solid compositions can be formed by preparing a melt, solidifying it by cooling, and then grinding and sieving to the desired size. It is highly preferred that the primary particles of the granules have a diameter of from about 50 to about 1,000, preferably from about 50 to about 400, more preferably from about 50 to about 200, microns. The granules can comprise smaller and larger particles, but preferably from about 85% to about 95%, more preferably from about 95% to about 100%, are within the indicated ranges. Smaller and larger particles do not provide optimum emulsions/dispersions when added to water. Other methods of preparing the primary particles can be used including spray cooling of the melt. The primary particles can be agglomerated to form a dust-free, non-tacky, free-flowing powder. The agglomeration can take place in a conventional agglomeration unit (i.e., Zig-Zag Blender, Lodige) by means of a water-soluble binder. Examples of water-soluble binders useful in the above agglomeration process include glycerol, polyethylene glycols, polymers such as PVA, polyacrylates, and natural polymers such as sugars.

The flowability of the granules can be improved by treating the surface of the granules with flow improvers such as clay, silica or zeolite particles, water-soluble inorganic salts, starch, etc.

EXAMPLES VI AND VII

| Examples VI and VII Solid Particulate Compositions | | |
|---|---|---|
| Components | VI Wt. % | VII Wt. % |
| Ester Quat Compound(1) | 81.1 | 83.7 |
| Ethoxylated Fatty Alcohol(2) | 5 | — |
| Coconut Choline Ester Chloride | — | 8 |
| $NH_yCl$ | 8 | — |
| Polyethyleneimine chloride slurry | — | 2.65 |
| Tartaric Acid | 1 | — |
| Citric Acid | — | 0.25 |
| Minors (Perfume, Antifoam) | 3.5 | 4.2 |
| Electrolyte | 1.4 | 1.2 |
| | 100 | 100 |

(1)Ester quat compound of Example II.
(2) $C_{16}$–$C_{18}E_{18}$.

EXAMPLE VI PROCESS

Molten diester is mixed with molten ethoxylated fatty alcohol. Other materials are then blended in with mixing. The mixture is cooled and solidified by pouring on a metal plate, and then ground and sieved.

EXAMPLE VII—PROCESS

The polyethyleneimine chloride is first prepared by mixing about 5 pans of polyethyleneimine MW 600 with about 12.14 parts of a 25% HCl aqueous solution in about 33.86 parts of distilled water. The water is then removed, e.g., by freeze drying, to yield a viscous slurry of ethyleneimine chloride containing about 8 parts of ethyleneimine chloride and 3 pans of water.

Molten diester is mixed with molten coconut choline ester chloride. Other materials are then blended in with mixing. The mixture is cooled and solidified by pouring on a metal plate, and then ground and sieved.

What is claimed is:

1. A rinse-added fabric softening composition selected from the group consisting of:

I. a solid particulate composition, comprising:

(A) from about 50% to about 95%, by weight of the composition, of biodegradable, cationic quaternary ammonium fabric softening compound;

(B) from about 0.01% to about 10%, by weight of the composition, of chlorine scavenger selected from the group consisting of:

1. amines;
2. ammonium salts;
3. amino acids, but not lysine;
4. polyamino acids;
5. polyethyleneimines;
6. polyamines, but not di(higher alkyl)cyclic amines nor their condensation products;
7. polyamineamides;
8. polyacrylamides; and
9. mixtures thereof;

(C) from about 0% to about 30%, by weight of the composition, of a modifier, for viscosity, dispersibility, or both; and (D) from about 0% to about 20%, by weight of the composition, of a pH modifier; and II. a liquid composition, comprising:

(A) from about 0.5% to about 50%, by weight of the composition, of biodegradable, cationic quaternary ammonium fabric softening compound;

(B) from about 0.01% to about 10%, by weight of the composition, of chlorine scavenger selected from the group consisting of:

1. water soluble primary and secondary amines of low volatility, selected from monoethanolamine, diethanolamine, tris(hydroxymethyl)aminomethane, and hexamethylenetetramine;
2. ammonium salts;
3. amino acids, but not lysine;
4. polyamino acids;
5. polyethyleneimines;
6. polyamines, but not di(higher alkyl)cyclic amines nor their condensation products;
7. polyamineamides;
8. polyacrylamides; and
9. mixtures thereof;

(C) from about 0% to about 30%, by weight of the composition of a modifier for viscosity, dispersibility, or both;

(D) the balance comprising a liquid carrier selected from the group consisting of water, $C_1$–$C_4$ monohydric alcohols, $C_2$–$C_8$ polyhydric alcohols, liquid polyalkylene glycols, propylene carbonate, and mixtures thereof, and wherein said composition has a pH of from about 2 to about 5.

2. The composition of claim 1 wherein said biodegradable cationic softener active has the general formula:

$$E^{+}[Y-R^2]_m pX^-$$

wherein p is 1 or 2;

m is 2 or 3;

each E is a nitrogenous quaternary ammonium group of charge $p^+$;

each Y is —O—(O)C—, or —C(O)—O—;

each $R^2$ is a $C_{11}$–$C_{22}$ hydrocarbyl or substituted hydrocarbyl substituent; and each $X^-$ is any softener-compatible anion.

3. The composition of claim 2 wherein p is 1; m is 2; $R^2$ is a $C_{15}$–$C_{17}$ hydrocarbyl or substituted hydrocarbyl substituent and wherein softener compatible anion is selected from the group consisting of: chloride; bromide; methyl sulfate; ethyl sulfate; formate; nitrate; and mixtures thereof.

4. The composition according to claim 1 wherein the level of said chlorine scavenger is from about 0.02% to about 5%, by weight of the composition.

5. The composition according to claim 4 wherein the level of said chlorine scavenger is from about 0.03% to about 4%, by weight of the composition.

6. The composition according to claim 1 (I.) wherein said chlorine scavenger is an amine selected from the group consisting of primary amines, secondary amines, alkanolamines, dialkanolamines, and mixtures thereof.

7. The composition according to claim 1 wherein said chlorine scavenger is an ammonium salt selected from the group consisting of ammonium chloride, ammonium bromide, ammonium titrate, ammonium sulfate, and mixtures thereof.

8. The composition according to claim 1 wherein said chlorine scavenger is a polyethyleimine having a molecular weight of less than about 2000.

9. The composition according to claim 8 wherein said polyethylenimine has a molecular weight from about 200 to about 1500.

10. The composition according to claim 1 wherein said chlorine scavenger is a polyamineamide having a molecular weight of less than about 5000.

11. The composition according to claim 1 wherein said chlorine scavenger is a polyacrylamide having a molecular weight of less than about 5000.

12. The composition of claim 1 wherein said modifier, for viscosity, dispersibility or both is selected from the group consisting of single long chain alkyl cationic surfactants; fatty acid choline esters; fatty amine amides; nonionic surfactants; and mixtures thereof.

13. The composition of claim 12 wherein said modifier is selected from the group consisting of nonionic surfactants selected from the group consisting of ethoxylated fatty acids, ethoxylated fatty alcohols, ethoxylated fatty amines, and mixtures thereof.

14. The composition according to claim 1 wherein said pH modifier is a Bronsted acid.

15. The composition according to claim 14 wherein said modifier is selected from the group consisting of citric acid, gluconic acid, tartaric acid, 1,2,3,4-butane tetracarboxcylic acid, and mixtures thereof.

16. The composition according to claim 1 wherein said liquid carrier comprises water.

17. The composition according to claim 1 wherein said liquid carrier is a mixture of water and a low molecular weight alcohol selected from the group consisting of ethanol, propanol, isopropanol, and mixtures thereof.

18. A rinse-added solid, particulate fabric softening composition comprising (A) from about 50% to about 95%, by weight of the composition, of a biodegradable cationic softener active having the formula:

$$E^{p+}[Y-R^2]_m pX^-$$

wherein p is 1 or 2;

m is 2 or 3;

each E is a nitrogenous quaternary ammonium group of charge $p^+$;

each Y is —O—(O)C—, or —C(O)—O—;

each $R^2$ is a $C_{11}$–$C_{22}$ hydrocarbyl or substituted hydrocarbyl substituent; and each $X^-$ is any softener-compatible anion.

(B) from about 0.01% to about 10%, by weight of the composition, of a chlorine scavenger; selected from the group consisting of:

1. amines;
2. ammonium salts;
3. amino acids, but not lysine;
4. polyamino acids;
5. polyethyleneimines;
6. polyamines, but not di(higher alkyl)cyclic amines nor their condensation products;
7. polyamineamides;
8. polyacrylamides; and
9. mixtures thereof; and (C) from about 3% to about 30%, by weight of the composition of a modifier for viscosity, dispersibility, or both; and (D) from about 0.01% to about 20%, by weight of the composition, of a pH modifier.

19. The composition of claim 18 wherein p is 1; m is 2; $R^2$ is a $C_{15}$–$C_{17}$ hydrocarbyl or substituted hydrocarbyl substituent and said softener compatible anion is selected from the group consisting of: chloride; bromide; methyl sulfate; ethyl sulfate; formate; nitrate; and mixtures thereof.

20. The composition according to claim 18 wherein said cationic, biodegradable quaternary ammonium compound is present at a level of from about 60% to about 90%, by weight of the composition.

21. The composition of claim 18 wherein said chlorine scavenger is an amine selected from the group consisting of primary amines, secondary amines, alkanolamines, dialkanolamines, and mixtures thereof.

22. The compositions according to claim 18 wherein said chlorine scavenger is an ammonium salt selected from the group consisting of ammonium chloride, ammonium bromide, ammonium citrate, ammonium sulfate, and mixtures thereof.

23. The composition according to claim 18 wherein said pH modifier is a solid, water-soluble Bronsted Acid present at a level of from about 0.2% to about 5%, by weight of the composition.

24. The composition according to claim 23 wherein said pH modifier is selected from the group consisting of citric acid, gluconic acid, tartaric acid, malic acid, 1,2,3,4-butane tetracarboxcylic acid, and mixtures thereof.

25. A rinse added, liquid fabric softening composition, comprising:

(A) from about 0.05% to about 50%, by weight of the composition, of a cationic, biodegradable quaternary ammonium fabric softening compound having the general formula:

$$E^{p+}[Y-R^2]_m pX^-$$

wherein p is 1 or 2;

m is 2 or 3;

each E is a nitrogenous quaternary ammonium group of charge $p^+$;

each Y is —O—(O)C—, or —C(O)—O—;

each $R^2$ is a $C_{11}$–$C_{22}$ hydrocarbyl or substituted hydrocarbyl substituent; and each $X^-$ is any softener-compatible anion.

(B) from about 0.01% to about 10%, by weight of the composition, of a chlorine scavenger; selected from the group consisting of:

1. water soluble primary and secondary amines of low volatility, selected from monoethanolamine, diethanolamine, tris(hydroxymethyl)aminomethane, and hexamethylenetetramine;
2. ammonium salts;
3. amino acids, but not lysine;
4. polyamino acids;
5. polyethyleneimines;
6. polyamines, but not di(higher alkyl)cyclic amines nor their condensation products;
7. polyamineamides;
8. polyacrylamides; and
9. mixtures thereof, and (C) from about 0% to about 30%, by weight of the composition of a modifier for viscosity, dispersibility, or both; and (D) the balance comprising liquid carrier selected from the group consisting of water, $C_1$–$C_4$ monohydric alcohols, $C_2$–$C_6$ polyhydric alcohols, liquid polyalkylene glycols, propylene carbonate, and mixtures thereof, and wherein the pH of the composition is from about 2 to about 5.

26. The composition of claim 25 wherein p is 1; m is 2; $R^2$ is a $C_{15}$–$C_{17}$ hydrocarbyl or substituted hydrocarbyl substituent and said softener compatible anion is selected from the group consisting of: chloride; bromide; methyl sulfate; ethyl sulfate; formate; nitrate; and mixtures thereof.

27. The composition of claim 26 wherein said cationic biodegradable quaternary ammonium compound is present at a level of from about 15% to about 32%, by weight of the composition.

28. The compositions according to claim 25 wherein said chlorine scavenger is an ammonium salt selected from the group consisting of ammonium chloride, ammonium bromide, ammonium citrate, ammonium sulfate, and mixtures thereof.

29. A solid, particulate rinse-added fabric softening composition, comprising:

(A) from about 60% to about 90%, by weight of the composition, of a cationic, biodegradable quaternary ammonium fabric softening compound having the general formula:

$$E^{p+}[Y-R^2]_m pX^-$$

wherein E is a nitrogenous quaternary ammonium group of charge $p^+$; p is 1; Y is —O—(O)C—, or —C(O)—O—; m is 2; $R^2$ is a $C_{15}$–$C_{17}$ hydrocarbyl or substituted hydrocarbyl substituent and said softener compatible anion is selected from the group consisting of: chloride; bromide; methyl sulfate; ethyl sulfate; formate; nitrate; and mixtures thereof;

(B) from about 0.01% to about 10%, by weight of the composition, of chlorine scavenger comprising ammonium salts; and (C) from about 0% to about 30%, by weight of the composition of a modifier, for viscosity, dispersibility or both is selected from the group consisting of nonionic surfactants selected from the group consisting of ethoxylated fatty acids, ethoxylated fatty alcohols, ethoxylated fatty amines, and mixtures thereof, and (D) from about 0.01% to about 20%, by weight of the composition, of pH modifier selected from the group consisting of citric acid, gluconic acid, tartaric acid, malic acid, 1,2,3,4-butane tetracarboxcylic acid, and mixtures thereof.

30. A liquid, rinse-added fabric softening composition, comprising:

(A) from about 3% to about 50%, by weight of the composition, of a cationic, biodegradable quaternary ammonium fabric softening compound having the general formula:

$$E^{p+}[Y-R^2]_m pX^-$$

wherein E is a nitrogenous quaternary ammonium group of charge $p^+$; p is 1; Y is —O—(O)C—, or—C(O)—O—; m is 2; $R^2$ is a $C_{15}$–$C_{17}$ hydrocarbyl or substituted hydrocarbyl substituent and said softener compatible anion is selected from the group consisting of: chloride; bromide; methyl sulfate; ethyl sulfate; formate; nitrate; and mixtures thereof;

(B) from about 0.001% to about 10%, by weight of the composition, of chlorine scavenger comprising ammonium salts; and (C) from about 0% to about 30%, by weight of the composition of a modifier, for viscosity, dispersibility or both is selected from the group consisting of nonionic surfactants selected from the group consisting of ethoxylated fatty acids, ethoxylated fatty alcohols, ethoxylated fatty amines, and mixtures thereof; and (D) water; and wherein said composition has a pH of from about 2 to about 5.

* * * * *